United States Patent [19]

Schmidt

[11] Patent Number: 4,557,002

[45] Date of Patent: Dec. 10, 1985

[54] BATHTUB ELEVATOR

[76] Inventor: Peter Schmidt, Wittumweg 38, D-7989 Eisenharz, Fed. Rep. of Germany

[21] Appl. No.: 621,785

[22] Filed: Jun. 18, 1984

[30] Foreign Application Priority Data

Jul. 7, 1983 [DE] Fed. Rep. of Germany ..... 3324294

[51] Int. Cl.[4] ..... A47K 3/12

[52] U.S. Cl. ..... 4/564; 4/565; 4/566; 91/410

[58] Field of Search ..... 4/560–566, 4/559, 495, 504; 91/410; 137/426; 251/335 A

[56] References Cited

U.S. PATENT DOCUMENTS

| | | | |
|---|---|---|---|
| 377,840 | 2/1888 | Smith | 91/410 |
| 602,512 | 4/1898 | Lecher et al. | 137/426 |
| 954,040 | 4/1910 | Morrison | 137/426 |
| 2,734,773 | 2/1956 | Ivins | 251/335 A |
| 3,958,282 | 5/1976 | Crowe | 4/566 |
| 4,407,029 | 10/1983 | Schmidt | 4/564 |
| 4,419,776 | 12/1983 | Schmidt | 4/564 |

FOREIGN PATENT DOCUMENTS

| | | | |
|---|---|---|---|
| 1044571 | 12/1978 | Canada | 91/410 |

*Primary Examiner*—Stephen Marcus
*Assistant Examiner*—Linda J. Sholl
*Attorney, Agent, or Firm*—Kuhn Muller and Bazerman

[57] ABSTRACT

A bathtub elevator consists of a floor frame, two tong-like guiding linkages, a lifting plate and two flexible lifting tubes, which are adapted to be filled with water under pressure. By means of a manually controllable valve, the flexible lifting tubes can be selectively connected to a supply line or to a drain line and can be shut off from both lines. An adjustable automatic elevation-limiting apparatus comprises a shutoff valve, which is incorporated in the supply line and actuated by means of a U-shaped member, which is displaced by the displaceable ends of the guiding linkage when the desired maximum elevation, which corresponds to the height of the bathtub, has been reached.

7 Claims, 5 Drawing Figures

BATHTUB ELEVATOR

This invention relates to a bathtub elevator for disabled persons, comprising a floor frame, at least one guiding linkage attached to the floor frame, a lifting plate supported by said guiding linkage, a lifting apparatus, which is disposed between said lifting plate and the floor frame and adapted to be operated with water under pressure, and a manually operable control valve for filling and draining the lifting apparatus, wherein the guiding linkage comprise two juxtaposed, spaced apart pairs of tong levers, the tong levers of each pair are pivotally interconnected at their center and each of said tong levers is provided at one end with a fixed swivel bearing, which is connected to the floor frame or to the lifting plate, and at the other end with a slide bearing, which is slidable along a rail.

Such bathtub elevator is known. The lifting of the lifting plate must be very carefully controlled by means of the manually operable control valve if the elevator is to be arrested in the desired position, in which it is flush with the rim of the tub. Disabled persons are often not able to perform said control. But if the control valve is not actuated when the lifting plate has been raised to its uppermost position, which is defined by the structure of the elevator, e.g., by mechanical stops, then the full supply pressure will be applied to the lifting apparatus so that the bathtub elevator may be damaged.

It is an object of the invention to provide a novel bathtub elevator in which the lifting plate is arrested exactly in a predetermined raised position independently of an actuation of the control valve.

Another object is to avoid an exertion of excessively high forces on the guiding linkage.

A further object of the invention is to provide a bathtub elevator in which the pressure built up in the lifting apparatus can never exceed the pressure which corresponds to the load applied to the lifting plate.

The nature of the invention resides generally in that the manually operable control valve incorporates a shutoff valve having a movable valve control member, which cooperates with an actuating member, which is in a position for holding the valve control member in a position for closing the shutoff valve when the lifting plate has been raised to a predetermined elevation.

In one embodiment the actuating member is a traction chain, which is secured at its upper end to the valve control member of the shutoff valve, which is secured to the lifting plate, whereas the lower end of the chain is secured to the floor frame. In an alternative embodiment, the shutoff valve is secured to one tong lever and its valve control member is arranged to engage a lug of one tong lever when the lifting plate has been raised to a predetermined position.

The embodiments defined in the dependent claims are preferred.

The advantage afforded by the invention resides in that the user need not direct his or her attention to the control of the lifting plate during the lifting operation in order to ensure that this will be arrested in the desired raised position because this will be automatically effected in that the shutoff valve is closed so that the supply of water under pressure is discontinued.

Because in accordance with the invention the lifting movement is limited in that the water supply line is shut off, the pressure in the lifting apparatus will always be adapted to the instantaneous load on the lifting plate. It is preferable to use at least one flexible lifting tube and to apply to said tube a pressure which is just sufficient to lift the lifting plate. When the lifting plate is being raised without a load, the flexible lifting tubes will be filled with water but the pressure therein will only slightly exceed the atmospheric pressure. When a load is then applied to the lifting plate, it will slightly descend but the shutoff valve will open immediately so that the pressure in the flexible lifting tubes will rise to compensate the load and the lifting plate will again be raised to the original desired upper position.

The invention will be described more in detail with reference to the drawing, which shows an embodiment by way of example.

Figure 2:
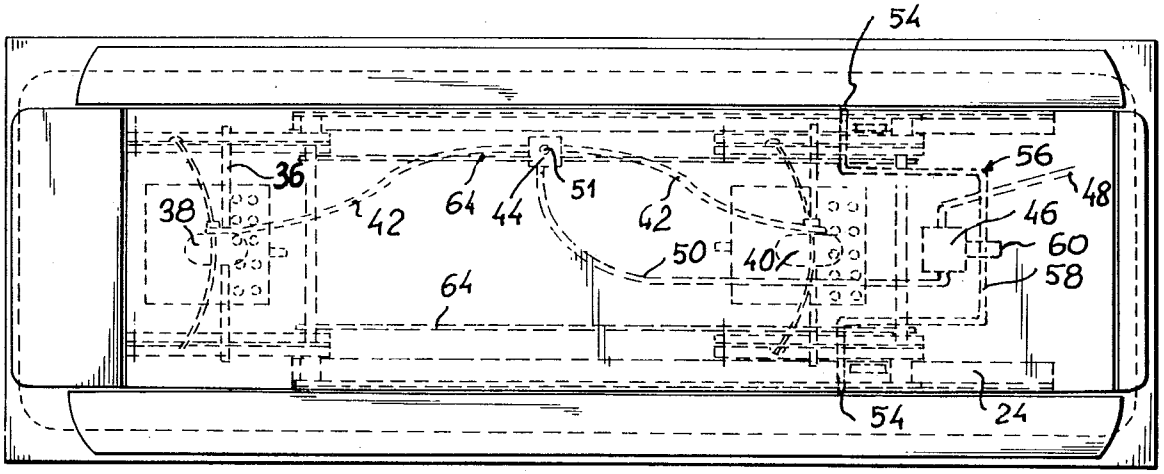
FIG. 2 is a top plan view showing the bathtub elevator of FIG. 1.

The bathtub elevator is generally designated 10 and comprises a floor frame 12, two guiding linkages 14, 16 which are mounted on said floor frame, and a lifting plate 18, which is supported by said guiding linkages. Each guiding linkage consists of two pairs of tong levers 20, 22. The two tong levers 20 are pivoted at their lower ends to the floor frame and are provided at their upper ends with slide bearings 26, which are slidable in channel rails 24. The two other tong levers 22 of each guiding linkage 14 are pivoted at their upper ends to the lifting plate 18 and are not slidable relative to the latter. The levers 22 are provided at their lower ends with slide bearings 30, which are slidable in rails 32 that are secured to the floor frame 12. The two tong levers 20, 22 of each pair of guiding linkages 14, 16 are interconnected at their center by an articulated joint 34. The two articulated joints 34 may be interconnected by a rod 36, as is shown in FIG. 2. The lower slide bearings 30 of the guiding linkage 14 are articulatedly connected to the corresponding lower slide bearings 30 of the other guiding linkage 16 by respective struts 64 so that a coupling mechanism is provided by which the lifting plate 18 can be horizontally adjusted.

Two flexible tubes 38, 40 for holding water under pressure are dispodsed between the floor frame 12 and the lifting plate 18 and are associated with respective ones of the guiding linkages 14, 16. Said flexible tubes 38, 40 constitute the lifting apparatus. Woven-fabric flexible tubes are used, which are about 80 to 100 mm in diameter. The ends of the flexible tubes are sealed and screwed to the floor frame 12 and to the lifting plate 18. Flexible connecting tubes 42 extend from a manually operable control valve 44 and are connected in parallel and open into respective ones of the flexible lifting tubes 38, 40 at the upper end of the latter.

A shutoff valve 46 is secured to the underside of the lifting plate 18 and is connected to a flexible tube 48 for supplying water under pressure. The outlet of the shutoff valve 46 is connected by a flexible connecting tube 50 to the manual control valve 44. A drain line 45 (FIG.

5) extends from the manually operable control valve 44 and may be hung, e.g., into a nearby washbasin.

Figure 1:
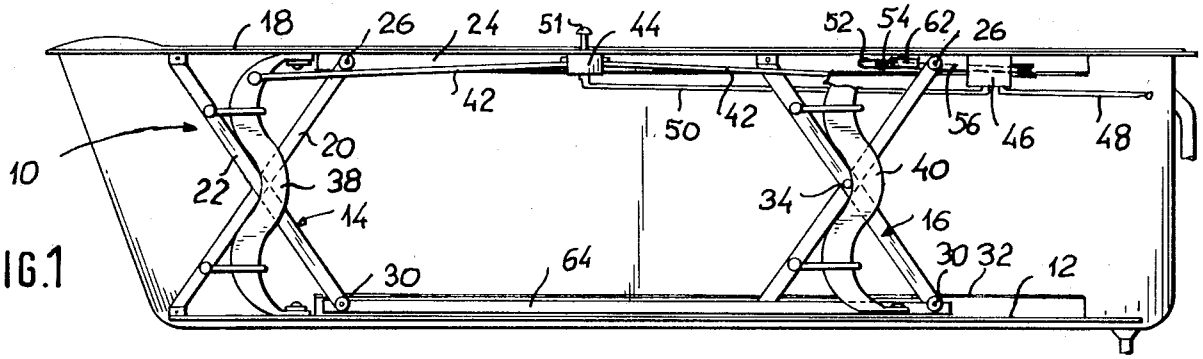
FIG. 1 is a diagrammatic side elevation showing a bathtub elevator in which the lifting plate is in the desired raised position.

Adjacent to the guiding linkage 16, the rails 24 associated with the upper slide bearings 26 are provided with transversely aligned longitudinal slots 52, which receive outwardly offset and transversely aligned arms of a U-shaped actuating member 56. The latter comprises a yoke 58 that extends through the valve control member 60 connected to a valve member 74 of the shutoff valve 46. The actuating member 56 is biased by springs, not shown, to the right in FIGS. 1 and 2 toward a position in which the shutoff valve 46 is open and the arms 54 engage the lower ends of the slots 52. A spacer 62 is inserted in each rail 24. The length of that spacer determines the desired raised position of the lifting plate 18. Said spacers consist of plastic members, which have been cut to a certain length. A plurality of said spacers may be arranged one behind the other in such a manner so that the slide bearings 26 will push the spacers 62 against the arms 54 just before the lifting plate 18 has been raised to its desired position. When the lifting is then raised further so that the upper slide bearings 26 are displaced to the left in FIGS. 1 and 2 only by a few millimeters, the actuating member 56 will be moved by said slide bearings 26 to the left by the same distance so that the valve control member 60 will be pushed into the shutoff valve 46 until the latter is closed. As a result, the supply of water under pressure is interrupted and the upward movement of the lifting plate 18 is terminated immediately. In this case the displacement of the actuating member 56 is as large as the stroke of the valve control member 60.

To prevent the spacers 62 from falling out of the rails 24, said upper rails consist of horizontally open channels and are provided at their lower leg with an upstanding retaining flange. The open width of the channel is approximately as large as the height of the spacer or spacers 62.

The lever 51 for controlling the manually operable control valve 44 is movable to three positions. In the intermediate position, shown in FIG. 1, the flexible lifting tubes 38, 40 are shut off. The lifting plate can be arrested in any desired position in that the lever 51 is moved to that intermediate position. In one end position of the lever 51, the flexible lifting tubes 38, 40 are connected to the drain line 49 so that the lifting plate 18 descends. In the other end position of the control lever the flexible lifting tubes are connected by means of the open shutoff valve 46 to the supply line 48 for water under pressure which exactly corresponds to the load which is instantaneously applied to the lifting plate 18.

Figures 3, 4:
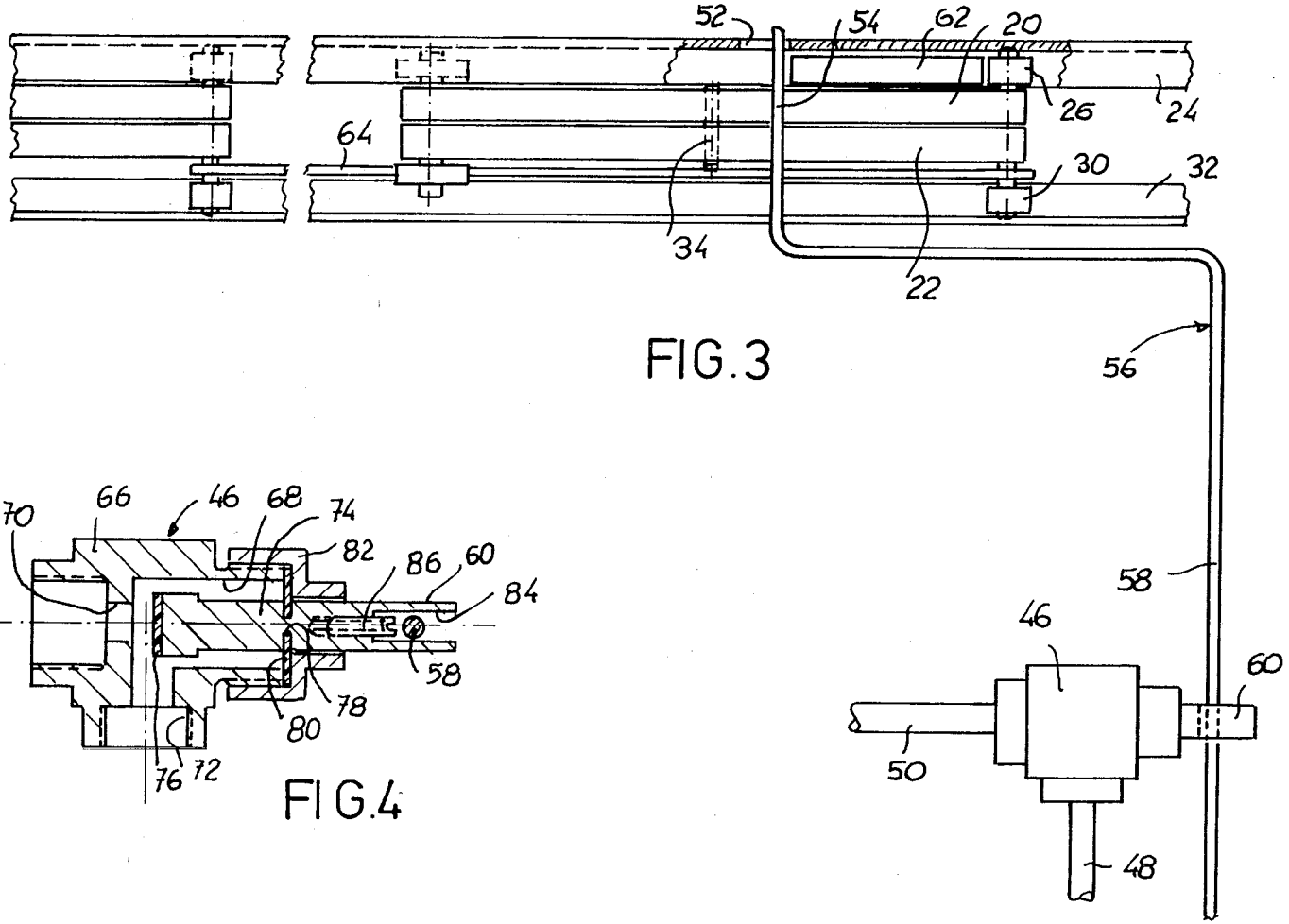
FIG. 3 is a enlarged longitudinal sectional view taken on a plane which is slightly spaced below the lifting plate.
FIG. 4 is a vertical sectional view showing the shutoff valve in open position which is diagrammatically indicated in FIG. 3.

FIG. 4 is a sectional view showing the shutoff valve 46. The housing 66 of the shutoff valve 46 has a through bore 68 which is formed with a throat 70, which constitutes the valve seat. A transverse bore 72 for connection to the supply line 48 opens into the through bore 68. The flexible tube 50 is connected to the left-hand end of the through bore 68 downstream of the valve seat 70. A valve member 74 is longitudinally slidably mounted in the through bore 68 and at its foward end face carries a rubber disc 76. The stem of the valve member 74 is formed with an annular groove 78, which receives resilient ring 80, which at its outside periphery is urged by a screw-threaded sleeve 82 into sealing contact with the right-hand end face of the valve housing 66. the valve member 74 is integral with the control member 60, which protrudes from the housing 66 and is formed at its outer end with a transverse slot 84, which is open at one end and receives the yoke 58 of the channel-shaped actuating member 56.

An adjusting screw 86 is screwed in the bottom of the transverse slot 84, which is a through slot. Said adjusting screw 86 can be used for a fine adjustment of the desired raised position of the lifting plate 18. By the resilient ring 80, the valve member 74 is held in the position, shown in FIG. 4, in which the shutoff valve 46 is open. In that position the ring 80 is planar, when the actuating member 56 applies pressure to the valve control member 60, the latter will be displaced by a few millimeters until the rubber disc 76 of the valve member 74 closes the valve at its valve seat 70. By this operation the disc 80 is deformed to a conical shape. When a higher load is then applied to the lifting plate 18 or the control valve 44 is shifted to the position for the descent of the lifting plate, the valve member 74 will return to its open position, shown in FIG. 4, under the bias of the resilient ring 80.

Figure 5:
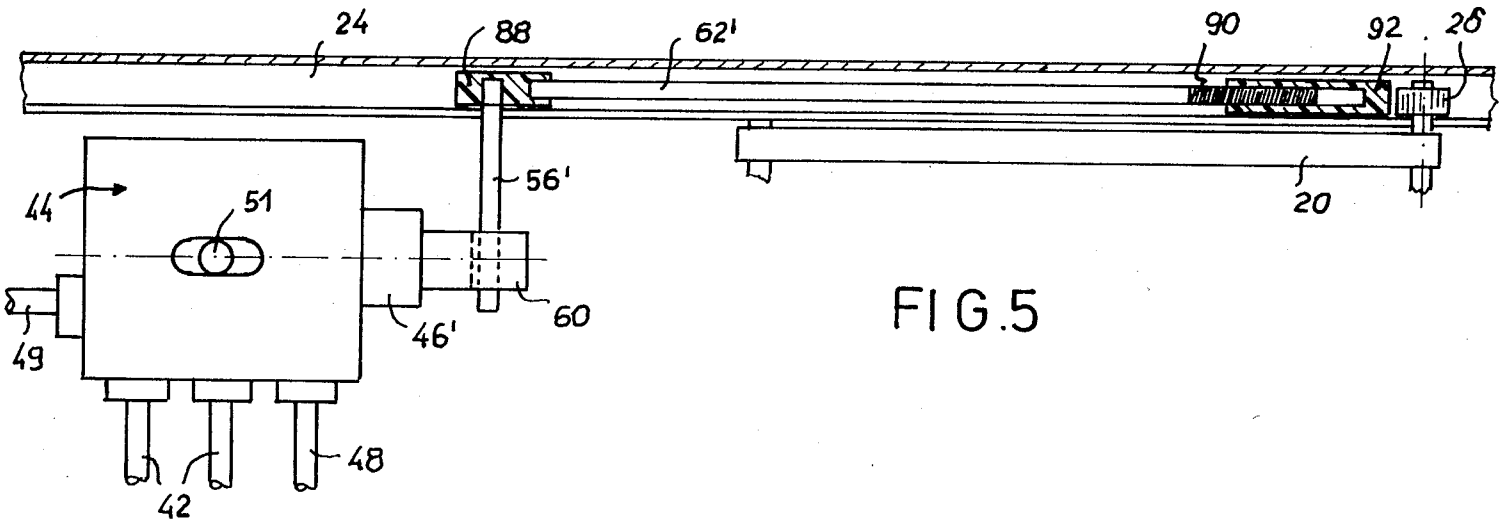
FIG. 5 is a vertical sectional view that is similar to FIG. 3 and shows a modified embodiment.

In the embodiment shown in FIG. 5, the shutoff valve 46' is integrated in the manually operable control valve 44. The supply line 48 for water under pressure opens directly in the manually operable control valve 44. The connecting line 50 is omitted. In this case the actuating member 56' consists of a short transverse rod 56', which is secured in a slider 88, which is slidable in the channel-shaped rail 24. The transverse rod 56' extends into a transverse slot of the valve control member 60. The slider 88 carries a longitudinal rod 62', which is provided at its end with screw threads 90, with which the rod 62' is screwed into another slider 92, which is also slidably guided in the rail 24. The assembly 56', 88, 62' 92 constitutes the spacer, which can be infinitely adjusted in length and can be removed from the rail 24 for an adjustment.

We claim:

1. An elevator for disabled persons, comprising a floor frame, at least one guiding linkage attached to the floor frame, a lifting plate supported by said guiding linkage, a lifting apparatus, which is disposed between said lifting plate and the floor frame and adapted to be operated with water under pressure, and a manually operable control valve for filling and draining the lifting apparatus, wherein the guiding linkage comprise two juxtaposed, spaced apart pairs of tong levers, the ton levers of each pair are pivotally interconnected at their center, and each of said tong levers is provided at one end with a fixed swivel bearing, which is connected to the floor frame or to the lifting plate, and at the other end with a slide bearing, which is slidable along a rail, a shutoff valve preceding the manually operable control valve in the flow path of the water under pressure flowing to the lifting apparatus and comprising a valve control member engaged by an actuating member, displacing the valve control member into a position for closing the shutoff valve when the lifting plate has been raised to a predetermined elevation, the actuating member provided with an arm extending into the path of a spacer, sliding in unison with the slide bearing of at least one tong lever during the closing stroke of the valve control member, and said arm constituting a mechanical stop for said spacer when the shutoff valve is in its closed position.

2. An elevator according to claim 1 wherein the spacer which moves in unison is adjustable in length.

3. An elevator according to claim 1, wherein the actuating member consists of a rod, which is slidably held at both ends in slots formed in the rails and has an intermediate portion in engagement with the valve control member.

4. An elevator according to claim 3, wherein the actuating member consists of a U-shaped member, which is provided at its ends with aligned arms, which extend outwardly in mutually opposite directions at right angles from the legs of the U-shaped member and into the slots formed in the rails, and the yoke of the U-shaped member is mounted in the valve control member.

5. An elevator according to claim 4, wherein the outer end of the valve control member is formed with a transverse slot and the actuating member extends through said slot.

6. An elevator according to claim 5, wherein a coaxial adjusting screw is provided at the bottom of the transverse slot and is screwable in the valve control member.

7. An elevator according to claim 1, characterized in that the shutoff valve is incorporated in the housing of the manually operable control valve.

* * * * *